United States Patent [19]

D'Cruz et al.

[11] 3,961,433

[45] June 8, 1976

[54] PICTURE POSTER VIEWER

[75] Inventors: Errol D'Cruz; June D'Cruz, both of Bramalea, Canada

[73] Assignee: The Raymond Lee Organization, Inc., New York, N.Y.; a part interest

[22] Filed: June 21, 1974

[21] Appl. No.: 481,653

[52] U.S. Cl. ..... 40/31

[51] Int. Cl.[2] ..... G09F 11/28

[58] Field of Search..... 40/31, 89, 88, 86 R, 40/87, 90–95, 47, 42; 192/41 S, 56 C; 188/83, 166

[56] References Cited

UNITED STATES PATENTS

| | | | |
|---|---|---|---|
| 1,219,619 | 3/1917 | Bell | 40/42 |
| 2,514,264 | 7/1950 | Soper | 188/83 |
| 2,633,950 | 4/1953 | Phaneuf | 192/41 S |
| 2,736,973 | 3/1956 | Mageoch | 40/31 X |
| 3,510,973 | 5/1970 | Mazzocco, Sr. | 40/31 |
| 3,776,331 | 12/1973 | Gustafsson | 188/166 |
| 3,780,458 | 12/1973 | Jacoby et al. | 40/31 |

*Primary Examiner*—Louis G. Mancene
*Assistant Examiner*—John H. Wolff
*Attorney, Agent, or Firm*—Howard I. Podell

[57] ABSTRACT

A movable picture poster supported by a take-up roller and a supply roller. The drive mechanism of this picture poster unit is composed of means to vary speed, vary direction, to start and stop as well as means to control the time during which the picture poster is exposed for viewing.

2 Claims, 12 Drawing Figures

FIG. 6
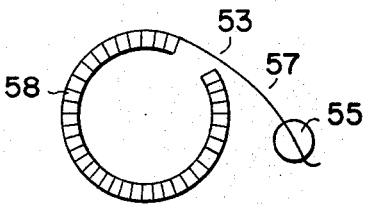
FIG. 7
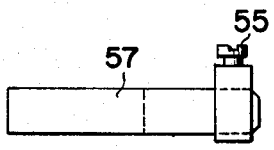
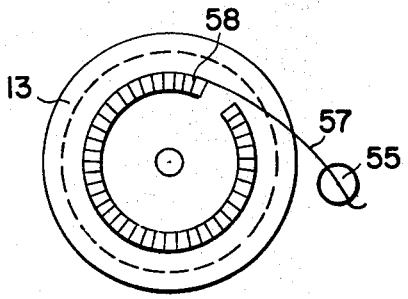
FIG. 8
FIG. 9
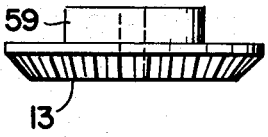
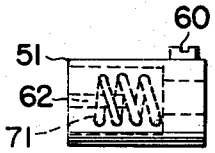
FIG. 10
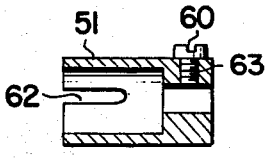
FIG. 11
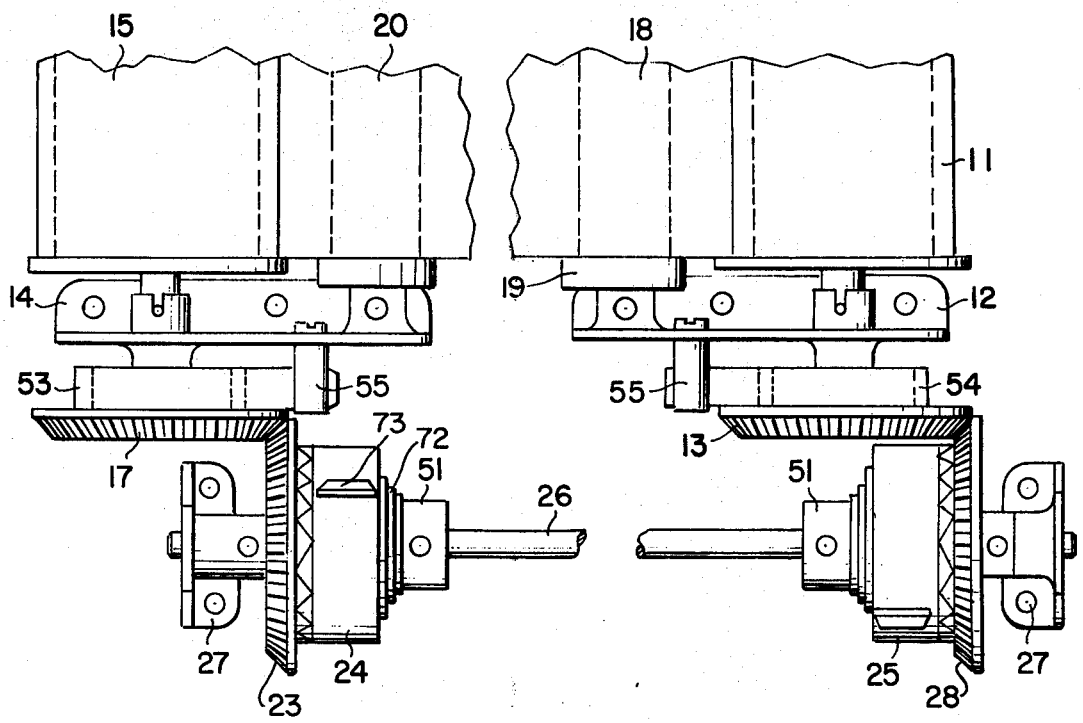
FIG. 12

PICTURE POSTER VIEWER

SUMMARY OF THE INVENTION

My invention relates to a device for the exhibiting of a continuous series of individual picture posters.

A picture frame is fitted with a pair of rollers on which a roll of pictures is mounted, with the rollers connected to a reversible drive shaft. Means are supplied for varying direction as well as speed of the roller, together with a means for stopping or starting the rotation of the rolls, as well as means for controlling the time during which an individual picture on the roll is exposed for viewing between the rolls. Means are provided to replace a roll of pictures.

A major advantage of my invention is that it provides a method of controlled view for one of a series of picture posters on a roll.

BRIEF DESCRIPTION OF THE DRAWING

The objects and features of the invention may be understood with reference to the following detailed description of an illustrative embodiment of the invention, taken together with the accompanying drawings in which:

FIG. 6 illustrates a side view of brake clutch assembly of the invention;

FIG. 7 illustrates a top view of the brake clutch assembly of the invention;

FIG. 8 illustrates a side view of the bevel gear of the invention;

FIG. 9 illustrates a top view of the beveled gear of the invention;

FIG. 10 illustrates a front view of the sleeve of the coil spring tension and clutch unit;

FIG. 11 illustrates a sectional view of the sleeve of the coil spring tension and clutch unit of the invention; and FIG. 12 illustrates a top view of the drive mechanism of the invention.

DESCRIPTION OF THE PREFERRED EMBODIMENT

Figure 1:
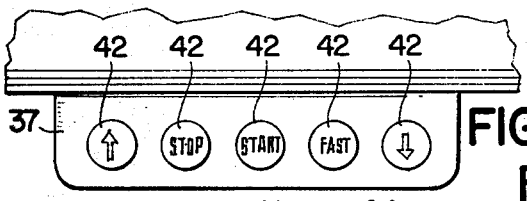
FIG. 1 illustrates a front view of the control panel of the invention.
Figure 2:
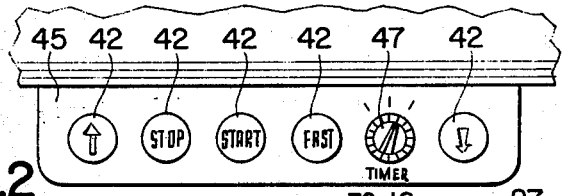
FIG. 2 illustrates a front view of an alternate control panel of the invention.
Figure 3:
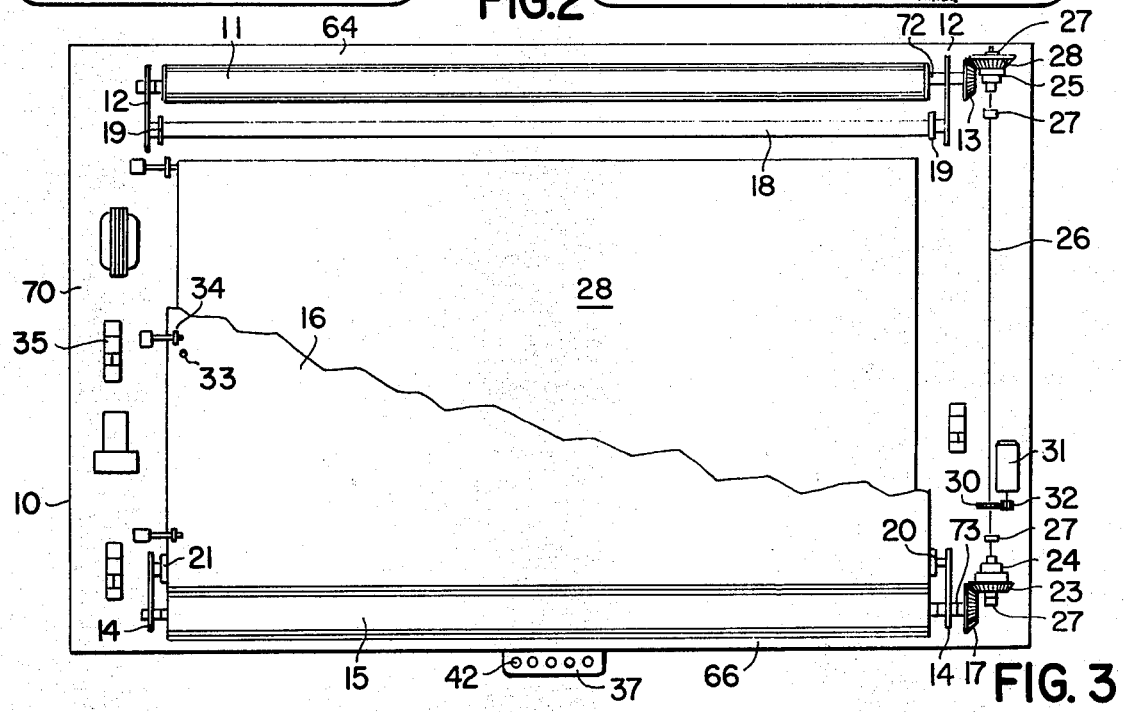
FIG. 3 illustrates a front view of the invention.
Figure 4:
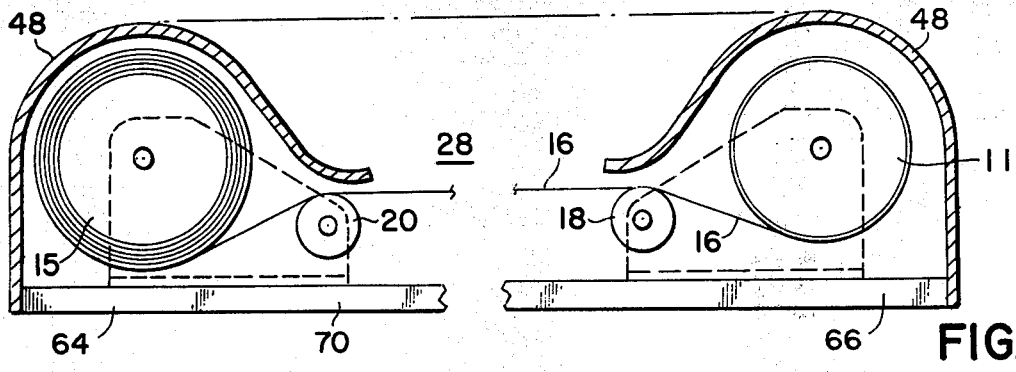
FIG. 4 illustrates a side sectional view of the invention.

Turning now descriptively to the drawings, in which similar reference characters denote similar elements throughout the several views, FIGS. 1–4 show the construction of the automatic poster picture frame 10 which is composed of a rectangular base board 70 onto which the picture roll 16 is mounted on feed roller 11 and take-up roller 15.

Feed roller 11 is anchored by means of pedestal bearing brackets 12 along the top edge 64 of the base board 70, with a beveled gear 13 fitted on one end of the axle 72 of horizontal hollow roller 11. A take-up roller 15 secured to the opposing bottom edge 66 of base board 70 by means of pedestal support bearing brackets 14, with beveled gear 17 fitted to the end of axle 73 of hollow roller 15.

Bevel gears 13 and 17 mate with bevel gears 28 and 23 respectively fixed to shaft 26 that is supported by bearing brackets 27. A gear 30 fixed to shaft 26 is engaged by a spur gear 32 of drive motor 31 for rotatably driving rollers 11 and 15 in either direction of feed. An idle roller 18 with end guide collars 19 which functions as guides for picture poster 16 is positioned below adjacent to and parallel to roller 11 and is supported by means of pedestal support bearing brackets 12. A second idle roller 20 with end collars 21 is mounted adjacent and parallel to roller 15 and supported by pedestal support bearing brackets 14. Mechanically operated coil spring tension and clutch assemblies 24 and 25 are connected respectively to bevel gears 22 and 23 so that axial movement of drive shaft 26 engages one of the two bevel gears 22 or 23 with the other bevel gear rotating freely on shaft 26.

Four pedestal support bearing brackets 27 support the drive shaft 26.

Picture poster 16 is wound about roller 11 and passes over idle roller 18 and past the viewing aperature 28 of the device to feed over idle roller 20 and take-up roller 15.

A punch hole 33 is located in the vertical edge of picture poster 16 for orientation of an individual picture on poster 16 with the viewing aperture 28. A roller contact switch 34 is mounted on the base board 70 with the switch 34 roller positioned so as to contact punch hole 33 as it rolls past switch 34. When punch hole 33 of the moving poster picture 16 becomes aligned with the roller contact switch unit 34 to activate switch 34, a solenoid 35 is controlled by switch 34 to stop drive motor 31. Control buttons 42 are mounted on a panel 37 to control speed and direction of motion of drive motor 31 and to start and stop the motor 31. Alternately a timer device 47 may be mounted on alternate control panel 45 to regulate the duration of stoppage of motor 31 for each individual picture or poster 16 when the device is in automatic drive.

The rollers 11 and 15 are each housed by hollow frame 48 which is fastened to the exterior edges of base 70.

Figure 5:
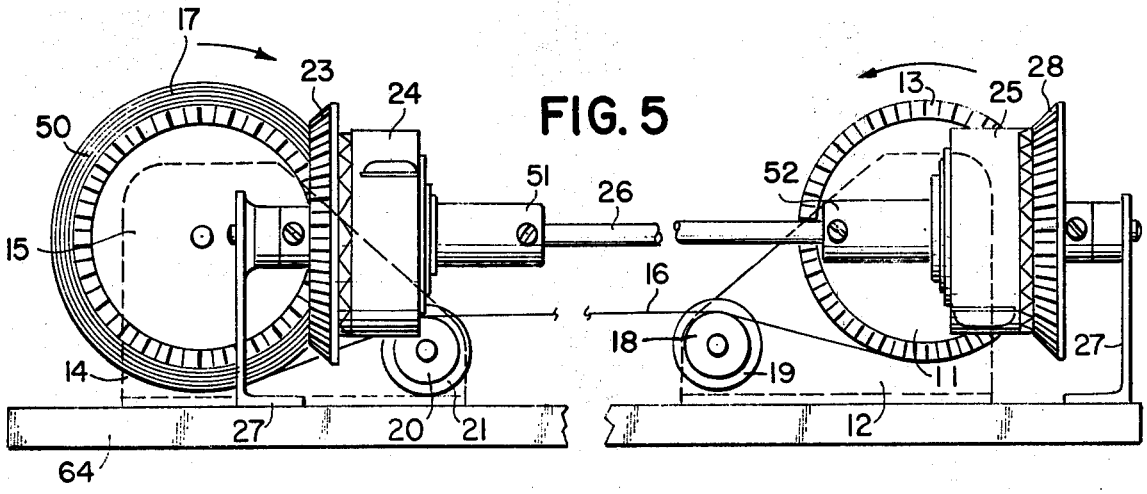
FIG. 5 illustrates a side sectional view of the drive mechanism of the invention.

FIGS. 5–12 show the construction of the drive mechanism 50 of the automatic picture poster unit 10. Sleeves 51 and 52 are connected to each end of drive shaft 26. Clutch assemblies 24 and 25 are connected to sleeves 51 and 52 and to bevel gears 23 and 28 respectively. Picture rollers 11 and 15 are respectively connected to bevel gears 13 and 17 which are in engagement with bevel gears 23 and 28 respectively. Each clutch brake assemblies 53 and 54 consists of a tension flat spring 57 fitted with a friction lining 58 on the inside surface of spring 57. Anchor bolt 55 holds springs 57 in position. Each bevel gear 13 and 17 has a large diameter boss 59 on which a spring 57 is wound. The sleeve 51 fits onto the drive shaft 26 and is locked in position by screw 60. A compression spring 71 fits inside the recess of sleeve 51, and one end of a coil spring 72 fits into slot 62 of sleeve 51. The sleeve 51, with compression spring 71 and coil spring 72, fits into the housing of clutch assembly 24, and the other end 73 of the coil spring 72 is attached to the housing of clutch assembly 24. The housing of clutch assembly 24 bears against bevel gear 23, as a clutch. Bevel gear 23 is driven by the coil spring under constant tension.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A picture poster viewing device for the viewing through an aperature of a single individual picture on a strip imprinted with a plurality of pictures comprising, a picture frame adaptable for mounting to a flat surface, said frame formed with an open viewing aperature, a strip of flexible sheeting upon which a plurality of pictures are imprinted, with the opposed ends of said strip mounted upon a pair of rollers, rotatably mounted in spaced parallel orientation, each located on an opposite side of the viewing aperature from the other, reversible motorized means to rotate both rollers so as to wind the strip upon one roller and unwind the strip upon the other roller, said motorized means rotatably linked to a drive shaft, with each roller fixed to an individual roller shaft, each roller shaft fitted with a first bevel gear, about the boss of which flat frictional spring means are externally wound to serve as a clutch brake, each said first bevel gear being individually meshed with a second bevel gear, each of said second bevel gears being joined to the drive shaft by an individual clutch assembly incorporating a coil spring joining the drive shaft to the clutch assembly in constant tension and a compression spring biasing the respective clutch assembly against each of the second bevel gears, with the frictional spring means about the boss of each of the first bevel gears being wound in an opposite direction from the frictional spring means wound about the other first bevel gear, so that in a given direction of rotation of the drive shaft, one of the first bevel gears is under braking torque causing the clutch assembly of the associated second beveled gear to slip with relation to the drive shaft, and retarding the motion of the roller associated with said first bevel gear.

2. The combination as recited in claim 1 in which the frictional spring means externally wound about each first bevel gear boss consists of a flat spring fitted with a frictional lining on the surface of the spring in contact with the boss of the said first bevel gear about which it is wound.

* * * * *